US005915535A

United States Patent [19]

Henrekin-Jordan

[11] Patent Number: 5,915,535

[45] **Date of Patent: *Jun. 29, 1999**

[54] ADJUSTABLE STRAP FASTENER ASSEMBLY FOR BODY-ENCIRCLING HAT BAND, COLLAR OR BELT

[76] Inventor: Susan Henrekin-Jordan, 4575 Discovery Point, Byron, Calif. 94514

[ * ] Notice: This patent is subject to a terminal disclaimer.

[21] Appl. No.: 08/919,741

[22] Filed: Aug. 28, 1997

Related U.S. Application Data

[63] Continuation-in-part of application No. 08/798,351, Feb. 10, 1997, abandoned, which is a continuation of application No. 08/373,743, Jan. 17, 1995, Pat. No. 5,600,854.

[51] Int. Cl.[6] ..... A42B 1/22

[52] U.S. Cl. ..... 2/195.2; 2/171; 2/183; 2/311; 2/312; 2/DIG. 11; 24/197

[58] Field of Search ..... 2/183, 195.2, 311, 2/312, 338, 171, DIG. 11; 24/197, 306

[56] References Cited

U.S. PATENT DOCUMENTS 4,878,274 11/1989 Patricy ..... 24/306
5,600,854 2/1997 Henrekin ..... 2/195.2

FOREIGN PATENT DOCUMENTS

9408/27 of 1928 Australia ..... 24/197

*Primary Examiner*—Diana L. Biefeld
*Attorney, Agent, or Firm*—Brown, Martin, Haller & McClain, LLP

[57] ABSTRACT

An adjustable fastener assembly for forming an adjustable loop around a portion of a wearer's body has an elongate member for encircling the body portion and first and second ends. A pair of rings are secured to the first end, and the second end is in releasable threaded engagement through the rings with the free end on one side of the loop. Secondary fasteners such as mateable strips of Velcro® material are provided on the opposing faces of the free end and face of the loop so that the free end can be secured to the loop. The elongate member may be a belt or waistband, a collar for an animal, or a hat band or sweatband of a cap or hat.

27 Claims, 2 Drawing Sheets

ADJUSTABLE STRAP FASTENER ASSEMBLY FOR BODY-ENCIRCLING HAT BAND, COLLAR OR BELT

CROSS-REFERENCES TO RELATED APPLICATIONS

This application is a Continuation-In-Part of application Ser. No. 08/798,351 filed Feb. 10, 1997, now abandoned, which was a Continuation of application Ser. No. 08/373,743 filed Jan. 17, 1995, now U.S. Pat. No. 5,600,854.

BACKGROUND OF THE INVENTION

The present invention relates generally to adjustable fasteners for tightening body-encircling members around an appropriate portion of a wearer's body, such as adjustable hat bands, belts, animal collars and the like.

Belts, animal collars and similar straps for encircling a wearer's waist or an animal's neck typically have a buckle at one end through which the other strap end is threaded and adjustably secured. The free end of the strap typically lies loosely on the outside of the loop formed by the fastened belt. Various types of buckles are known, and most consist of one or more rings of metal or the like, through which the free strap end is drawn, tightened, and then secured. Similar fastening devices are used for adjusting the fit of a hat by selectively reducing or increasing the diameter of a hat band extending around the internal periphery of the hat. The loose or free strap end can be a problem and may allow the strap to slip back and loosen the band.

SUMMARY OF THE INVENTION

It is an object of the present invention to provide a new and improved adjustable fastener assembly for securing in a loop around a portion of a wearer's body.

According to the present invention, an elongate member is provided for encircling a portion of a wearer's body, the elongate member having an inner face facing the body, an outer face, and opposite first and second ends, a pair of overlapping rings secured to the first end of the elongate member, the second end comprising a strap for releasable threaded engagement through the rings with a free end portion of the strap projecting out of the rings, whereby a loop is formed for releasably fitting around the body portion, and a fastener for securing the free end portion of the strap to the loop.

In a preferred embodiment of the invention, the fastener comprises opposing strips of hook and loop type fastener material, such as Velcro®, on opposing surface portions of the elongate member and free end portion of the strap. The strap is threaded through the rings and doubled back on the inside or outside of the loop so that the strips of hook and loop fastener material face each other, and is then pressed against the opposing strip on the face of the loop. By providing the connection on the inner face of the loop, pressure of the wearer's body or hoop tension against the inner flap or end of the strap will tend to hold the opposing fastener devices in place and prevent slipping. This also avoids the problem of having a loose strap end hanging freely on the outside of a loop. In some cases, it is preferable to position the free end of the strap on the outside of the loop, so that the loop can be tightened readily while it is worn. The free end of the strap is securely fastened, so there will be no loose end and the loop will be secure.

The elongate member may comprise a hat band or sweatband extending around the lower peripheral edge of a hat, for example, while the interengageable buckle and strap allow the periphery of the hat to be adjusted to fit the wearer's head. Alternatively, it may comprise a collar for fitting around an animal's neck, or a belt for fitting around a wearer's waist.

The strap end may be threaded in one direction through the center of one of the rings, then around the outside of the second ring and doubles back in the opposite direction through the center of the second ring and back through the first ring to the inside or outside of the resultant loop. Alternatively, the strap end may be threaded through the center of both rings, and back around the outside of one ring and through the center of the other ring to form a secure first fastener mechanism. The free end is then secured to the opposing surface of the loop, forming a second fastener for added security. Preferably, the rings are of non-rigid, flexible but non-extensible material such as fabric, rope, nylon line, and other equivalent materials. This avoids the use of metal and thus reduces the risk of injury to the wearer in the case of impact, and will be more comfortable for the wearer.

This arrangement provides an adjustable fastener for a hat, belt, collar or the like which is capable of securely holding a hat, belt or collar in any one of a large number of adjusted positions, and provides both a desirable appearance and comfort in use. The combination of overlapping loops forming a buckle with a secondary fastener on the inside or outside of the loop provides the required strength to prevent slipping and loosening after the fastener is secured.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 1:
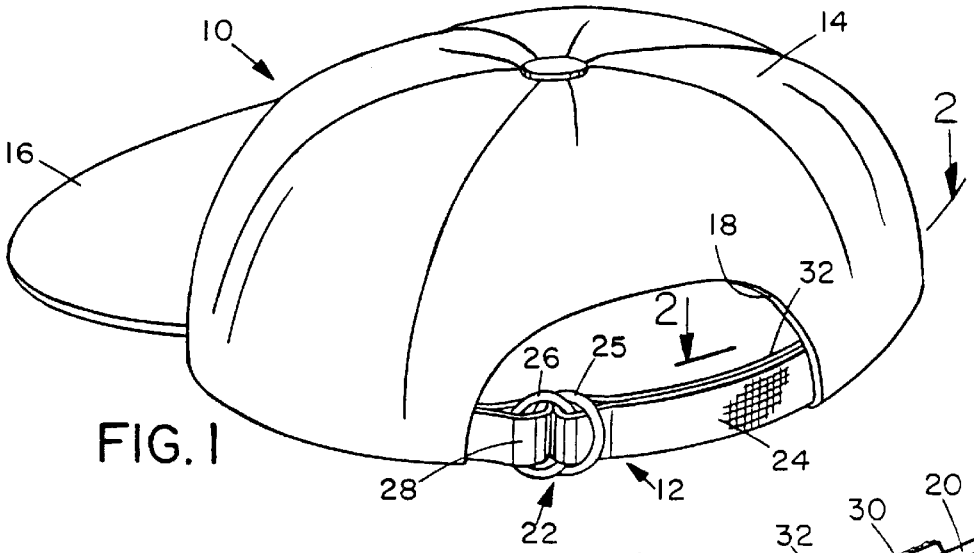
FIG. 1 is a perspective view of a typical cap incorporating an adjustable fastener assembly according to one embodiment of the invention.

FIG. 1 of the drawings illustrates a hat or cap 10 having an adjustable fastener assembly 12 for adjusting the periphery of the cap to fit around a wearer's head. Although the hat illustrated is of the baseball cap type, it will be understood that the same adjustable fastener assembly may be used on other styles of hat in an equivalent manner. The cap 10 includes a head-covering crown portion 14, a front visor 16, and an adjustment opening 18 at the rear. A sweatband 20 or the like extends around the internal periphery of the cap adjacent its lower edge, and the adjustable fastener assembly 12 comprises interengageable end portions projecting from opposite sides of the opening 18, one of the end portions comprising a buckle 22 and the other end portion comprising a strap 24 for threaded engagement through the buckle.

Figure 2:
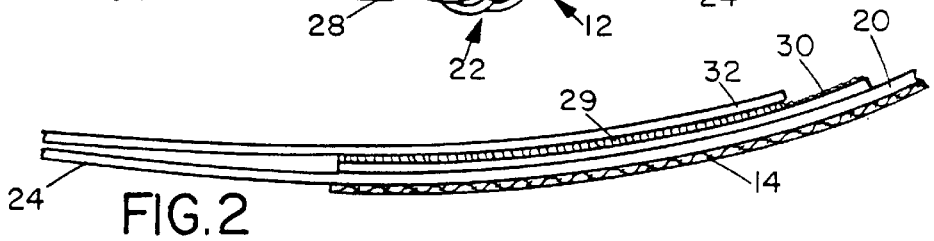
FIG. 2 is an enlarged sectional view taken on line 2—2 of FIG. 1.

The buckle comprises a pair of overlapping inner and outer rings 25, 26 which are each secured to a strap loop 28 which is attached by stitching or the like to one side of opening 18. The rings 25, 26 are preferably of a non-rigid, non-extensible material such as fabric, rope or the like. Strap 24 is secured at one end to the opposite side of opening 18, or may comprise an extension of hat band 20. The free end of strap 24 can then be threaded through the overlapping rings and doubled back to the desired extent so that the resultant loop is a close fit over the wearers head. The strap is threaded through the rings so that the free end of the strap is on the inside of the resultant loop, rather than on the outside as is conventional in buckle fasteners. A secondary fastener is provided between the free end of the strap and the inside of the loop by means of mateable strips 29, 30 of hook and loop type fastener material on the inside of hat band 20 adjacent the opening 18 and on the inner face of the strap 24 adjacent its free end 32, as best illustrated in FIG. 2. The hook and loop type fastener material is preferably Velcro®. Other types of interengageable fastener devices may be provided, such as snap fasteners or the like, although Velcro® is preferred since it will be more comfortable for the wearer and will provide a larger degree of adjustability and make it easier to adjust the amount of overlap between the two strips.

The manner in which the strap 24 is threaded through the overlapping rings and doubled back on the inside of the resultant loop or ring is best illustrated in FIG. 1. The strap is first threaded through the center of the first or inner ring 25, then around the outside of outer ring 26 before doubling back through the centers of both ring 26 and ring 25 to be located on the inside of the resultant loop. The strap is pulled through the buckle before tightening to a sufficient extent to achieve the desired loop diameter. The buckle rings are then tightened to grip the doubled over portion of the strap, and the resultant free end portion is pressed against the inner face of the loop so that the Velcro® strip 29 is pressed against the opposing Velcro® strip 30 to secure the free end of the strap to the inside of the loop.

This forms a compact, comfortable and secure fastener of attractive appearance which can be adjusted quickly and easily as needed. The tension on the loop and the radial pressure of the wearer's head against the overlapping Velcro® strips will tend to make the connection even more secure, rather than tending to loosen the fastener as is the case with equivalent buckles where the free strap end is on the outside of the loop. Also, there are no free strap ends on the outside which would otherwise tend to give a more untidy appearance to the adjustable fastener. Since the loops are of fabric or like non-rigid material, there will be no uncomfortable metal buckle parts pressing against the wearer's head, and the loops can be made of any desired fabric color to match or coordinate with the remainder of the cap and the strap 24 and strap loop 28.

Figure 3:
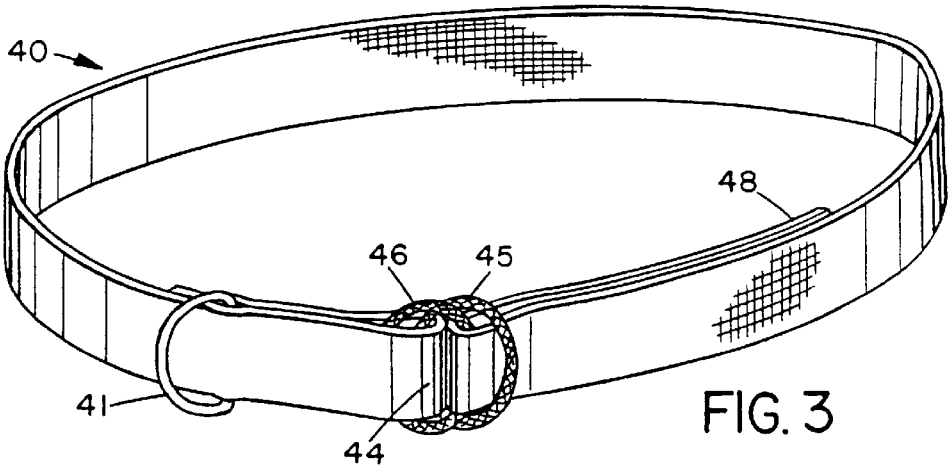
FIG. 3 is a perspective view of a belt or collar incorporating the fastener assembly.

Although the adjustable fastener assembly is described above in connection with adjustment of the size of a cap or hat, it may be used with any item of clothing or the like which is intended to encircle a portion of a wearer's body, in order to provide size adjustment. FIG. 3 illustrates an alternative embodiment of the invention in which the adjustable fastener assembly forms an integral part of a belt or collar 40 for adjustable engagement around the waist of a wearer or the neck of an animal, respectively, rather than part of a hat or cap. In this embodiment, an elongate strap or belt 40 has a loop 44 at one end in which a pair of overlapping inner and outer rings 45, 46 are secured to form a buckle, and an opposite free end 48 for threading through the rings 45, 46 to form a continuous loop, in an equivalent manner to fastener assembly 12 of the previous embodiment.

As in the previous embodiment, a first strip 50 of hook and loop fastener material is provided on the inner face of the strap adjacent the free end 48, and an opposing strip 52 of mating hook and loop fastener material is provided on the inner face of the loop formed by the belt or strap at a location adjacent the fastener assembly. The rings 45, 46 are also of non-rigid, non-extensible material such as fabric or rope as in the previous embodiment. In the case of an animal collar, an additional ring 41 will be secured to the strap adjacent the fastener assembly for holding identification tags, license tags and the like, and for attachment of a lead as necessary, as indicated in dotted outline in FIG. 3.

Figure 4:
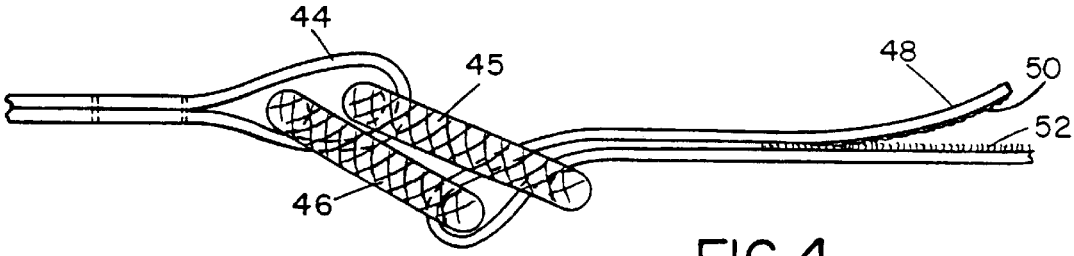
FIG. 4 is an enlarged top plan view of the fastener loosely engaged.

In order to secure the belt or collar around a waist or neck, after looping the belt around the desired region, the free end 48 of the belt is threaded through the center of ring 45, then around the outside of ring 46 and back through the centers of rings 46 and 45, as best illustrated in FIG. 4. The free end 48 is then located on the inside of the loop formed by the belt. The free end 48 is pulled through until the desired tightness is achieved, the buckle is tightened, and free end 48 is then pressed against the underlying inner face of the loop as illustrated in FIG. 4, so that the mating Velcro® strips 50 and 52 are engaged.

This arrangement avoids the inconvenience of a free strap end lying on the outside of a belt or collar, and also provides a secondary fastener between the opposite ends of the belt for added security. The arrangement is such that radial force on the inside of the belt will tend to tighten, rather than loosen, the buckle and Velcro® attachments. The fabric or rope buckle rings will be more comfortable than the conventional metal buckles generally used on belts and collars, and will have a more attractive appearance.

Figure 5:
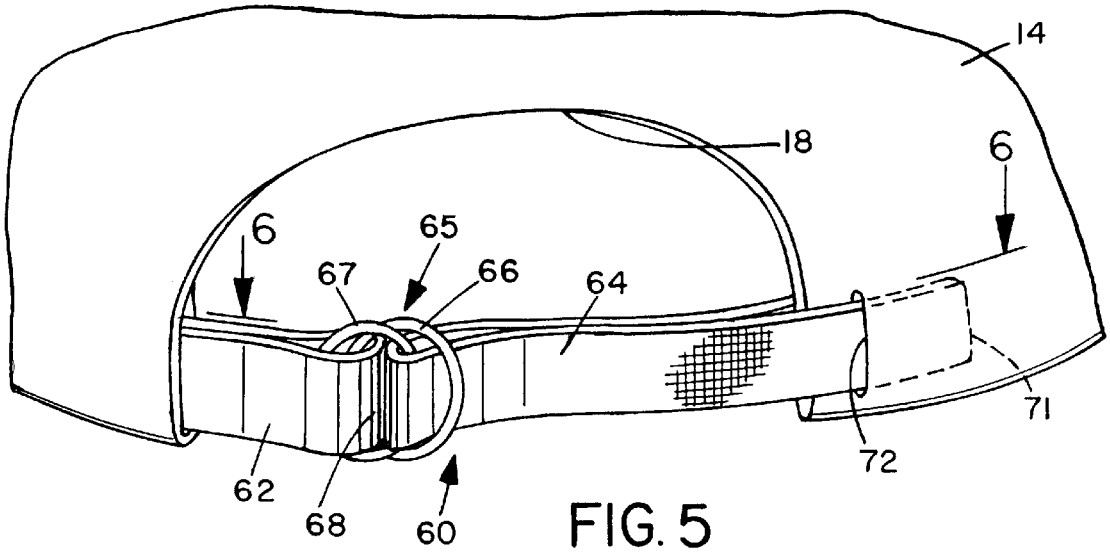
FIG. 5 is a rear elevation view of part of a cap incorporating an adjustable fastener assembly according to another embodiment of the invention.
Figure 6:
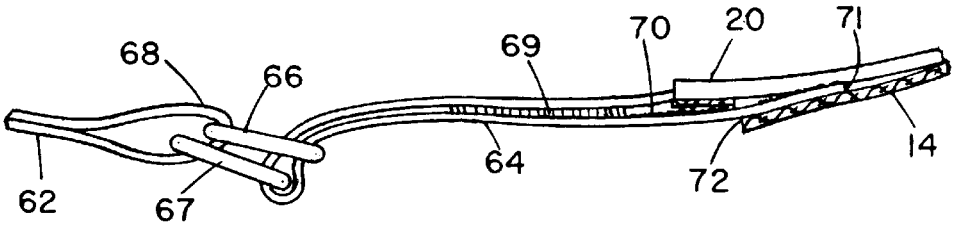
FIG. 6 is an enlarged sectional view taken on line 6—6 of FIG. 5.

FIGS. 5 and 6 of the drawings illustrate a fastener assembly 60 according to a second embodiment of the invention used to adjust the size of a cap or hat, for example a baseball style cap 14 as illustrated in FIG. 1. Sweatband 20 extends around the inner periphery of the cap adjacent its lower end, as indicated in FIG. 6. In this embodiment, the strap direction is reversed, and the free end of the strap is located on the outside of the cap, rather than on the inside as in the first embodiment. As in the first embodiment, the fastener assembly 60 can be used to adjust the periphery of the cap to fit around a wearer's head. However, unlike the first embodiment, assembly 60 can be adjusted while the hat or cap is worn, so that an accurate fit is easier to achieve.

The adjustable fastener assembly 60 comprises interengageable end portions 62, 64 projecting from opposite sides of opening or cut-out 18 at the rear of the cap or hat, one of the end portions having a buckle 65 and the other end portion comprising an elongate strap 64 for threaded engagement through buckle 65. Buckle 65 comprises a pair of overlapping inner and outer rings 66, 67 which are each secured to strap loop 68 which is attached by stitching or the like to one side of the opening. The rings 66, 67 are preferably of a non-rigid, non-extensible material such as fabric, rope, or the like, although they may alternatively be of metal, rubber, or plastic material.

The free end of the strap 64 is threaded through the rings and then doubled back to the desired extent so that the resultant periphery or loop of the cap is a close fit around a wearer's head. In this embodiment, the strap 64 is threaded from the inside to the outside of the loop, so that it is on the outside, rather than the inside, of the resultant loop. A secondary fastener is provided between the free end of the strap and the underlying outer surface of the strap or loop. Preferably, the secondary fastener comprises mating strips 69, 70 of hook and loop type fastener material such as Velcro®. One strip 69 is provided on the outside of strap 64 adjacent the end of opening 18 and the other strip 70 is provided on the outside of the strap 64 extending up to free end 71, as best illustrated in FIG. 6. A buttonhole 72 is provided in the cap adjacent the opening 18, so that the free end 71 of the strip can feed back to the inside through buttonhole 72, so that there is no loose or free strap end. A Velcro® strip (not visible in drawing) also may be provided on the inner face of sweatband 20 adjacent hole 72, for mating with an opposing portion of strip 70 inside the hole 72.

Although Velcro® is used for the secondary fastener in the preferred embodiment, other fasteners may be used such as snap fasteners or the like. Additionally, instead of a buttonhole 72 for stowing the free end of the strap, a slot, metal grommet, or the like may be used for stowing the strap end. Instead of a buttonhole 72, a Velcro® strip may alternatively be provided on the outside of the cap, and the strap 64 is then completely secured on the outside of the hat.

As illustrated in FIG. 6, the free end of the strap 64 is threaded first from the inside of the loop outwardly through the two rings 66,67, and then back around the outside of the outer ring 67 and through the inner ring 66. The free end is then pulled tight until the hat or cap is at the desired tightness around the wearer's head. The projecting strap end is then pressed against Velcro® strip 69 to secure the free end of the strap to the outside of the loop. The remaining loose end 71 of the strap is then tucked through the buttonhole 72 so that it does not hang free. The Velcro® strip 70 may extend up to the end 71 of the strap as in the illustrated embodiment or terminate short of end 71.

Threading of the strap end to the outside, rather than the inside as in the first embodiment, is desirable where security and tightness of the hat is essential, such as in vigorous sports or high winds, since the hat or cap can be tightened while on the head for a more accurate fit, and can be re-tightened if necessary without having to first remove the cap from the head. It is not possible to adjust the fastener assembly of the hat of FIGS. 1 and 2 without first removing it from the head.

The fastener assembly 60 of FIGS. 5 and 6 may also be used for the belt or collar of FIGS. 3 and 4, so that the free end of the belt is threaded to the outside, rather than the inside, of the belt loop. Again, this will provide easier access to the adjustment mechanism and allow it to be adjusted readily while the belt or collar is worn. In this case, a slot or buttonhole may be provided on the belt itself for stowing the free end of the belt after threading through the rings and attachment of the Velcro® strips, or alternatively a metal grommet or the like may be provided for this purpose.

The fastener assemblies of both of the embodiments described above are highly secure against slipping, due to the combination of a two-ring buckle with a secondary fastener securing the free end of the belt to the resultant loop, either on the inside or the outside of the loop. The second embodiment, in which the secondary fastener is on the outside, is more readily adjustable but still provides a secure fastening. At the same time, by making the rings of flexible or non-rigid material, the assembly is more comfortable for the wearer than fasteners employing hard or rigid buckle materials.

Although some preferred embodiments of the invention have been described above by way of example only, it will be understood by those skilled in the field that modifications may be made to the disclosed embodiments without departing from the scope of the invention, which is defined by the appended claims.

I claim:

1. An adjustable strap fastener assembly for securing in a loop around a portion of a wearer's body, comprising:

an elongate member for encircling a wearer's body, the elongate member having an inner face, an outer face, and opposite first and second ends;

a first fastener comprising a pair of overlapping rings of non-rigid material secured to the first end of the elongate member;

the second end comprising a strap for releasable threaded engagement through the rings to form the elongate member into a loop, whereby a free end portion of the strap projects from the rings and the loop and free end portion of the strap have first and second opposing faces, respectively; and a second fastener for securing the free end strap portion to the loop, the second fastener comprising a first interengageable portion on the first face of the free end portion of the strap and a second interengageable portion on the opposing, second face of the loop.

2. The assembly as claimed in claim 1, wherein the elongate member comprises a hat band.

3. The assembly as claimed in claim 1, wherein the elongate member comprises a peripheral rim of a hat.

4. The assembly as claimed in claim 1, wherein the elongate member comprises a belt for encircling a wearer's waist.

5. The assembly as claimed in claim 1, wherein the elongate member comprises a collar for encircling the neck of an animal.

6. The assembly as claimed in claim 1, wherein the rings are of flexible, non-extensible material.

7. The assembly as claimed in claim 6, wherein the rings are of rope material.

8. The assembly as claimed in claim 6, wherein the rings are of fabric material.

9. The assembly as claimed in claim 1, wherein the interengageable fastener devices comprise a first strip of hook type fastener material secured to one of said opposing faces and a second strip of loop type fastener material mateable with said hook type fastener material and secured to the other of said opposing faces.

10. A hat comprising:

a crown portion for covering the crown of a wearer's head, the crown portion having a front for location at the front of a wearer's head, a rear for location at the rear of a wearer's head, a concave inner face for facing a wearer's head when the hat is worn, and a convex outer face for facing outwardly from a wearer's head;

the crown portion having a cut out opening at the rear of the hat, the opening having opposite first and second side edges;

a pair of overlapping rings secured to the first side edge of the opening;

a fastener strap having opposite inner and outer faces, a first end of said strap secured to the second side edge of the opening and a second, free end for threading through said rings with the free end projecting from the rings, whereby said rings and fastener strap together form a first fastener for securing the hat on a wearer's head; and a second fastener for securing the free end of the fastener strap to the hat.

11. The hat as claimed in claim 10, wherein the second fastener comprises a first interengageable fastener device secured to the outer face of the fastener strap adjacent said second side edge of said opening and a second interengageable fastener device secured to the outer face of said fastener strap adjacent said free end for releasable engagement with said first interengageable fastener device when said second end is threaded through said rings from the inside to the outside of the hat and bent back over said outer face.

12. The hat as claimed in claim 10, wherein the rings are of non-rigid material.

13. The hat as claimed in claim 12, wherein the rings are of flexible, non-extensible material.

14. The hat as claimed in claim 11, including a hole in said crown portion adjacent said second side edge of said opening for receiving the second end of said fastener strap.

15. A securing assembly, comprising:

an elongate member bent to form a loop the elongate member having an inner face facing inwardly into the loop and an opposing, outer face, and opposite first and second ends:

a pair of overlapping rings secured to the first end of the elongate member:

a first interengageable portion secured to one face of the elongate member adjacent the second end and a second interengageable portion secured to said one face at a location spaced from said second end for releasable attachment to the first interengageable portion;

the second end of the elongate member being threaded through both of said rings and the first interengageable portion being secured to the second interengageable portion to secure the member in a loop;

the first and second interengageable portions being on the outer face of the elongate member and the second end of the elongate member being threaded through both of said rings from the inside to the outside of the loop;

the second end of the elongate member being threaded through the innermost ring and the outermost ring around the outside of the outermost ring, and back through the innermost ring to leave a free end on the outside of the loop, the free end carrying said first interengageable portion which is secured to said second interengageable portion; and an additional fastener for securing the second end of the elongate member to the outer face of the loop.

16. The assembly as claimed in claim 15, wherein the elongate member has a slot adjacent the second interengageable portion, the slot comprising said additional fastener, and the second end of the elongate member is threaded into said slot.

17. A securing assembly, comprising:

an elongate member bent to form a loop the elongate member having an inner face facing inwardly into the loop and an opposing, outer face, and opposite first and second ends;

a pair of overlapping rings secured to the first end of the elongate member, the rings being of non-rigid material;

a first interengageable portion secured to one face of the elongate member adjacent the second end and a second interengageable portion secured to said one face at a location spaced from said second end for releasable attachment to the first interengageable portion; and the second end of the elongate member being threaded through both of said rings and the first interengageable portion being secured to the second interengageable portion to secure the member in a loop.

18. The assembly as claimed in claim 17, wherein the first and second interengageable portions are on the outer face of the elongate member and the second end of the elongate member is threaded through both of said rings from the inside to the outside of the loop.

19. The assembly as claimed in claim 18, wherein the second end of the elongate member is threaded through the innermost ring and the outermost ring, around the outside of the outermost ring, and back through the innermost ring to leave a free end on the outside of the loop, the free end carrying said first interengageable portion which is secured to said second interengageable portion.

20. The assembly as claimed in claim 18, wherein said interengageable portions comprise a first strip of hook type fastener material and a second strip of loop type fastener material mateable with said hook type fastener material.

21. The assembly as claimed in claim 20, wherein the rings are of flexible, non-extensible material.

22. The assembly as claimed in claim 21, wherein the rings are of rope.

23. The assembly as claimed in claim 21, wherein the rings are of fabric.

24. A method of securing an elongate member around a portion of a wearer's body, comprising the steps of:

extending an elongate member around a portion of a wearer's body to form a loop having an inside and an outside, with an inner face of the member facing inwardly into the loop and outer face of the member facing outwardly, the member having a pair of overlapping rings at one end and a second, free end, the rings comprising an innermost ring and an outermost ring;

threading the second end of the elongate member through both of the rings;

pulling the second end through the rings until the loop has a selected diameter;

securing the second end to the loop; and the elongate member comprising the periphery of a hat and the step of extending the elongate member to form a loop comprising placing the hat on a wearer's head so that the elongate member extends around the periphery of the head.

25. The method as claimed in claim 24, wherein the step of threading the second end of the elongate member through both of the rings comprises threading the second end from the inside to the outside of the loop so that the second end lies on the outside of the loop.

26. The method as claimed in claim 25, wherein the step of threading the second end through the loop comprises threading the second end through the innermost ring and the outermost ring, then back around the outside of the outermost ring and through the innermost ring.

27. A method of securing an elongate member around a portion of a wearer's body, comprising the steps of:

extending an elongate member around a portion of a wearer's body to form a loop having an inside and an outside, with an inner face of the member facing inwardly into the loop and outer face of the member facing outwardly, the member having a pair of overlapping rings at one end and a second, free end, the rings comprising an innermost ring and an outermost ring;

threading the second end of the elongate member through both of the rings;

pulling the second end through the rings until the loop has a selected diameter;

securing the second end to the loop;

the step of threading the second end of the elongate member through both of the rings comprising threading the second end from the inside to the outside of the loop so that the second end lies on the outside of the loop; and inserting the second end of the elongate member through a hole in the loop.

* * * * *